US005463713A

United States Patent [19]

Hasegawa

[11] Patent Number: 5,463,713

[45] Date of Patent: Oct. 31, 1995

[54] SYNTHESIS OF SPEECH FROM TEXT

[75] Inventor: Kazsuya Hasegawa, Tokyo, Japan

[73] Assignee: Kabushiki Kaisha Meidensha, Tokyo, Japan

[21] Appl. No.: 232,438

[22] Filed: Apr. 21, 1994

Related U.S. Application Data

[63] Continuation of Ser. No. 877,782, May 4, 1992, abandoned.

[30] Foreign Application Priority Data

May 7, 1991 [JP] Japan ..... 3-101105

[51] Int. Cl.[6] ..... G10L 9/00

[52] U.S. Cl. ..... 395/2.69; 395/2.67

[58] Field of Search ..... 395/2.67–2.78; 381/51–53

[56] References Cited

U.S. PATENT DOCUMENTS

| | | | |
|---|---|---|---|
| 4,278,838 | 7/1981 | Antonov | 381/51 |
| 4,689,817 | 8/1987 | Kroon | 381/52 |
| 4,799,261 | 1/1989 | Lin et al. | 381/36 |

FOREIGN PATENT DOCUMENTS

| | | | |
|---|---|---|---|
| 0144731 | 6/1985 | European Pat. Off. | 381/51 |

*Primary Examiner*—Allen R. MacDonald
*Assistant Examiner*—Michelle Doerrler
*Attorney, Agent, or Firm*—Foley & Lardner

[57] ABSTRACT

An apparatus for synthesizing speech from text includes a language processing section which determines an accent environment of each mora of the text. In a basic accent pattern table, a basic accent pattern is classified according to the accent environment of the mora. The basic accent pattern includes a pitch data which is edited from real voice data according to the accent environment. A basic accent pattern processing section selects the basic accent pattern of each more from the basic accent pattern table according to the accent environment and processes the basic accent pattern in pitch according to the accent environment. A correcting section receives the corrected pitch data in the basic accent patter processing section and corrects the corrected pitch data according to the number of mora in each phrase and the position of the mora in phrase so as to correct the data into the corrected accent component. A phrase pattern processing section determines a phrase component according to the number of mora in each phrase which is of the accent environment. A speech synthesizing section synthesizes speech according to an accent control pattern of the text which is obtained by adding the accent pattern and the phrase pattern.

10 Claims, 4 Drawing Sheets

FIG. 2

| ACCENT ENVIRONMENT | ACCENT PATTERN |
|---|---|
| LHL | |
| LHH | |
| HLL | |
| ⋮ | ⋮ |
| LHH | |

LEVELING ⟹

| ACCENT ENVIRONMENT | PITCH | | | | |
|---|---|---|---|---|---|
| | P1 | P2 | P3 | ---- | Pn |
| LHL | 40 | 70 | 80 | ---- | 40 |
| LHH | 40 | 80 | 100 | ---- | 60 |
| HLL | 80 | 70 | 50 | ---- | 30 |
| ⋮ | | | | ⋮ | |
| LHH | | | | | |

FIG. 3

| ACCENT ENVIRONMENT | BOUNDARY POSITION OF ACCENT | PITCH | | | | |
|---|---|---|---|---|---|---|
| | | P1 | P2 | P3 | ----- | Pn |
| LHL | FRONT | 80 | 70 | 40 | ----- | |
| | REAR | 40 | 70 | 80 | ----- | |
| | NONE | 40 | 70 | 40 | ----- | |
| LHH | FRONT | 70 | 90 | 100 | ----- | |
| | REAR | 40 | 80 | 100 | ----- | |
| | | 40 | 80 | 100 | ----- | |
| ⋮ | ⋮ | | | | ⋮ | |

| ACCENT ENVIRONMENT | PROPERTY OF MORA | PITCH | | | | |
|---|---|---|---|---|---|---|
| | | $P_1$ | $P_2$ | $P_3$ | ----- | Pn |
| LHL | PROPERTY 1 | 40 | 80 | 40 | ----- | |
| | PROPERTY 2 | 40 | 60 | 70 | ----- | |
| | ⋮ | | | | ⋮ | |
| | PROPERTY n | 30 | 80 | 40 | ----- | |
| LHH | PROPERTY 1 | 40 | 80 | 100 | ----- | |
| | PROPERTY 2 | 40 | 60 | 100 | ----- | |
| | ⋮ | | | | ⋮ | |

SYNTHESIS OF SPEECH FROM TEXT

This application is a continuation of application Ser. No. 07/877,782, filed May 4, 1992, now abandoned.

BACKGROUND OF THE INVENTION

1. Field of the Invention

The present invention relates to improvements to an apparatus provided for speech synthesis of text by means of a regular synthetic method, and more particularly, to improvements in an apparatus for speech synthesis in which the accent of text data is controlled by an accent control method.

2. Description of the Prior Art

The automatic conversion of text to synthetic speech is commonly known as text to speech conversion or text to speech synthesis. A number of different techniques have been developed to make speech synthesis apparatus practical on a commercial basis. FIG. 5 shows a typical speech synthesis apparatus in which speech is synthesized by a regular synthetic method such as by using a connection rule of mora or rule of phoneme. The speech synthesis apparatus includes an accent control section 13 where a phrase pattern calculating section 13*a* is arranged to calculate a phrase component (which indicates the height of the voice in the part sandwiched between pauses) according to the number of mora contained in the text, and an accent pattern calculating section 13*b* is arranged to calculate an accent component (which shows the height of the sound of each word). The phrase component and the accent component are added to each other in a speech synthesizing section 14, and an accent control pattern is calculated as shown in FIG. 6. In general, the phrase component is continuously changed from a high pitch to a low pitch due to the lowering of the pressure under the glottis. The interpolation of the accent component is carried out by putting a pitch target value to each analysis element and linearly interpolating between pitches, or by putting three pitch target values to each analysis element and linearly interpolating among their pitches.

With the above mentioned accent control method in the speech synthesizer, an accent is applied to the synthesized speech by calculating the phrase component and the accent component. The accent component is determined by applying plural target pitches to each mora and linearly interpolating among their pitches.

However, since the pitch of the accent component is simply determined according to the height of the accent, the synthesized speech sounds mechanical due to its uniform change in the pitch. Further, since the interconnections between the syllables, and between the clauses are not taken into consideration, it is apt to cause unsmoothness in the height change of the accent and between moras. Accordingly, the synthesized speech generated by this method sounds unnatural.

In order to solve the above mentioned problem, another accent control method has been proposed, in which the changing coefficient of the pitch in the mora is determined by the linear function calculation according to the accent environment, in detail, according to the height of accent, the position in phrase, cotinuative phoneme or not, the accent height of forward and back mora of the mora, positional relationship with clause, and the target value at forward and back in the mora.

With such an accent control method, improved synthesized speech is provided. However, it is difficult to easily understand the changed accent pattern during the maintenance or when the a variable number is defined since the changing coefficient includes the variable number for controlling. This difficulty is further increased in proportion to the increase in the accent pattern. Furthermore, the calculating operations become more complicated since the function for generating the accent pattern and the defining of the variable number become complex.

SUMMARY OF THE INVENTION

It is an object of the present invention to provide an improved apparatus for speech synthesis which is free of the above mentioned drawbacks.

An apparatus for synthesizing speech from text, in accordance with the present invention, comprises a language processing section which determines an accent environment of each mora for each phrase of the text. In a basic accent pattern table, a basic accent pattern is classified according to the accent environment of the mora. The basic accent pattern includes a pitch data which is edited from real voice data according to the accent environment. A basic accent pattern processing section selects the basic accent pattern of each mora from the basic accent pattern table according to the accent environment and processes the basic accent pattern in the pitch according to the accent environment. A correcting section receives the basic accent pattern in the pitch in the basic accent pattern processing section and corrects the pitch according to the number of moras in each phrase and the position of the mora in the phrase so as to correct the data in the corrected accent component. A phrase pattern processing section determines a phrase component according to the number of moras in each phrase which is of the accent environment. A speech synthesizing section synthesizes speech according to an accent control pattern of the text which is obtained by adding the basic accent pattern and the basic phrase pattern.

With this arrangement, the accent pattern is easily understood by being imaged from the table data, and the maintenance of the speech synthesizer is easily carried out by correcting the data of the basic accent pattern table.

BRIEF DESCRIPTION OF THE DRAWINGS

The invention will be described in greater detail by reference to the following description taken in connection with the accompanying drawings, in which:

FIG. 2 shows tables which disclose a procedure for translating the accent pattern into the form of digitized table by leveling in use for the first embodiment;

FIG. 3 is an accent pattern table which is used in a second embodiment of the speech synthesis apparatus according to the present invention;

DETAILED DESCRIPTION OF THE INVENTION

Figure 1:
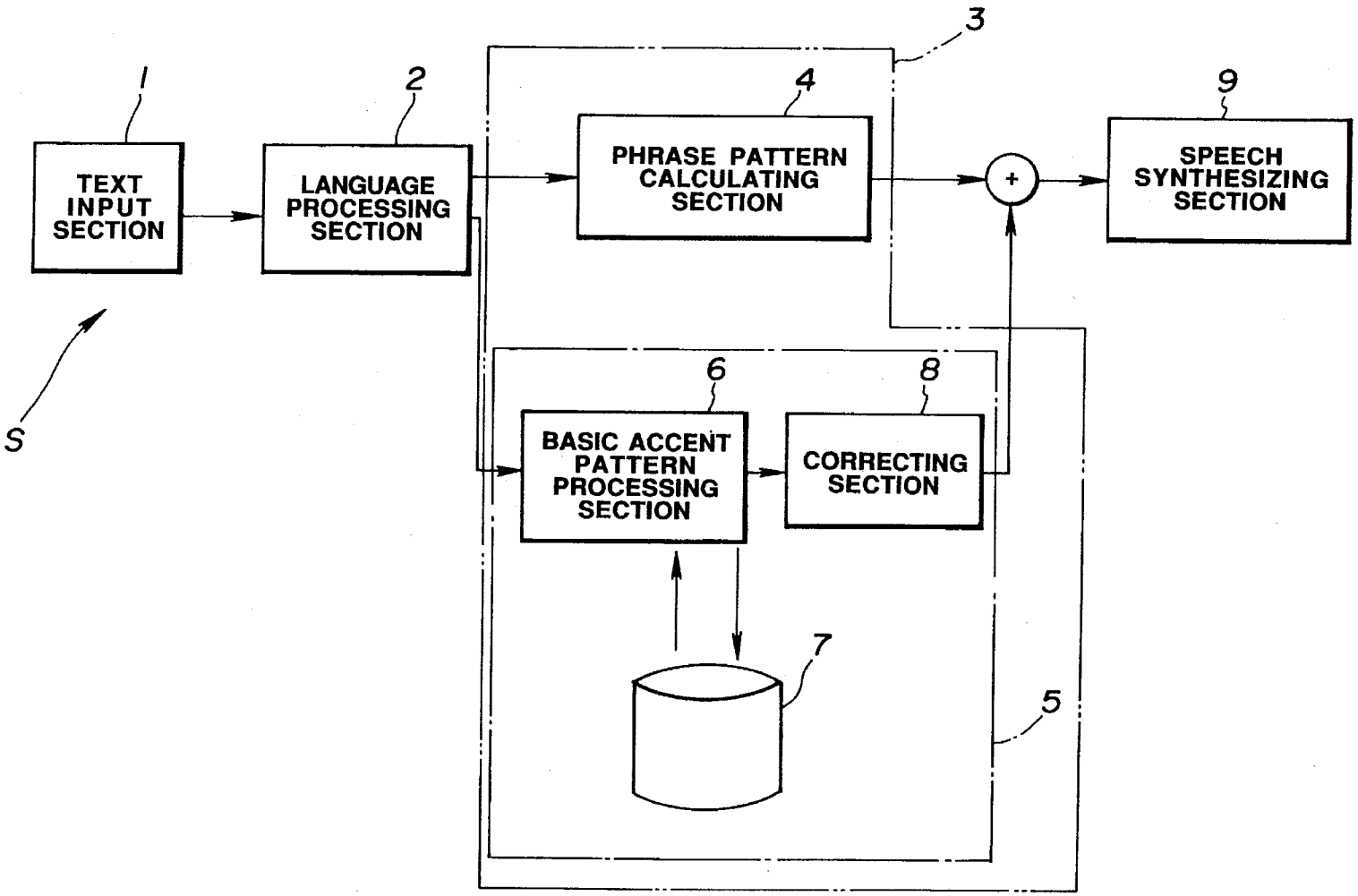
FIG. 1 is a block diagram of an apparatus of a first embodiment of a speech synthesizer according to the present invention.

Referring now to FIGS. 1 to 3, there is shown a first embodiment of an apparatus S for speech synthesis according to the present invention.

The apparatus S for speech synthesis comprises a text input section 1 at which text is inputted for being enunciated, as shown in FIG. 1. The text input section 1 is connected to a language processing section 2 in which the text content is analyzed by means of the morpheme analysis. The data processed in the language processing section 2 is sent to an accent control section 3 in which a phrase pattern calculating section 4 and an accent pattern processing section 5 are parallelly arranged. The phrase pattern calculating section 4 and the accent pattern processing section 5 receive the respective data from the language processing section 2. The accent pattern precessing section 5 includes a basic accent pattern processing section 6 and a correct processing section 8. The basic accent pattern processing section 6 is communicated with a basic accent pattern table 7 through which a proper basic accent pattern is selected. The data from the phrase pattern calculating section 4 and the accent pattern processing section 5 are sent to a speech synthetic section 9.

As a result of the language processing of the inputted text, the number of moras of each clause and the accent data of each mora in the text data are determined and sent to the accent pattern processing section 5. At the accent pattern processing section 5, the basic accent pattern is looked up from the basic accent pattern table 7 in accordance with the input accent environment. The basic accent pattern table 7 previously stores the date which is of a table of the pattern data gained by the pitch analysis of the original (real) speech. At the basic accent pattern table 7, a plurality of accent amount of each mora are classified according to the combination between the accent of the mora and the accent of its forward and back mora of the main mora. At the correcting section 8, the correction value of the basic accent pattern is determined according to the number of moras between the space and the position of the mora of the accent pattern processed in the language processing section 2. In accordance with the correction value, the basic accent pattern is corrected and the corrected accent pattern data is sent to the speech synthesizing section 9 for being combined with the phrase pattern data. The accent component and the phrase component are overlapped and function as an accent control pattern in the speech synthesizing section 9. The pitch of each syllable is controlled at a speech synthesizing section 9 according to the accent control pattern. The synthesized speech is outputted through an articulation filter according to the voice wave pattern and the parameter of the articulation filter which are in cooperated with each syllable.

FIG. 2 shows an original accent pattern table (a) in which the accent pattern is shown in the form of the graph produced, and a digitized accent pattern table (b) which is produced by digitizing the original table (a). The real speech data-base shown by the original table (a) is manually classified by means of the pitch analysis of the vocalization (speaking) according to each accent environment. For example, a plurality of the pitch data of the original speaking, in which the form of the accent combination (the combination of low accent L and high accent H) is LHL, are classified according to every accent environment in which the mora is analyzed with respect to the existence of the contiguous phoneme, the accent height of forward and back mora, the position of punctuation and the like. Accordingly, the proper accent pattern data is selected according to the accent environment even if the height change (LHL) of the accent of the mora is the same as that of the other moras. The basic accent pattern table (b) is determined by leveling and classifying the data of the real speaking data-base shown in the table (a) in accordance with the accent environment, and the table (b) of the basic accent pattern is memorized in the basic accent pattern table 7.

The manner of operation of the thus arranged apparatus S for speech synthesis will be discussed hereinafter with reference to one popular sentence of Japanese language.

For illustration the content of the text is assumed to be "Kyō wa ī tenki desu." which means "It is fine today." in English. The sentence is normally described in Japanese (Kanji and Kana), it is herein described by Romaji which is a method for writing Japanese in Roman character in order to facilitate the understanding of the discussion. The text content is inputted from the text input section 1 and sent to the language processing section 2. In the language precessing section 2, the sentence described in Japanese (Kanji and Kana) is translated into Romaji. Since Japanese is a an isosyllabic language, the sentence described in Romaji directly indicates the pronunciation of the sentence. Furthermore, the following table is obtained in the language processing section 2:

TABLE 1

| ANALYSIS ELE. | ACCENT | CV/C SEGMENT |
|---|---|---|
| KYŌ | 2 (HIGH) | CV |
| WA (CLAUSE B.P) | 1 (LOW) | CV |
| Ī (CLAUSE B.P.) | 2 | V |
| TE | 1 | CV |
| N | 1 | V |
| KI | 1 | CV |
| DE | 1 | CV |
| SU (PAUSE) | 1 | CV |

where CV is a consonant + vowel and V vowel.

where CV is consonant +vowel and V vowel.

Table 1 shows the accent environment of the inputted text, in detail, the height of accent, the accent position in phrase, the kind of mora and the like. Language processing section 2, analyzes whether each mora is cotinuative phoneme or not, now high is the accent height of forward and back mora of each mora, what positional relationship does each mora have in the clause, what is the target value at forward and back in the mora and the like. According to the data obtained in the language processing section 2, a phrase component is calculated. Further, in the basic accent pattern processing section 6, an accent component of each mora of the text is selected from the basic accent pattern table 7 according to the accent environment. In the correcting section 8, the correction value of the basic accent pattern is determined according to the number of moras between the space and the position of the mora of the accent pattern processed in the language processing section 2. In accordance with the correction value, the basic accent pattern is corrected and the corrected accent pattern data is sent to the speech synthesizing section 9 for being combined with the phrase pattern data.

With the thus arranged apparatus for speech synthesis, the accent pattern data corresponding to all of the accent environment is stored in the accent pattern table 7. Accordingly, the accent pattern data is easily looked up by using the accent environment as an index when the maintenance of the data is carried out, or the correction value is determined. Furthermore, since the accent pattern is stored in the accent pattern table 7 in the form of a plural accent amount (pitch) for every mora, the accent pattern for every mora is imaginably impressed. Therefore, the accent pattern is easily understood and amended as compared with a conventional method in which the accent component is calculated from functions and coefficient data. Additionally, since the accent pattern data has been generated from a real voice, the clear and realistic voice is easily obtained.

Referring to FIG. 3, there is shown another accent pattern table 7*a* of a second embodiment of an apparatus S for speech synthesis according to the present invention. The second embodiment is similar to the first embodiment except for the basic accent pattern table 7.

The basic accent pattern table 7*a* of the second embodiment is classified on the basis of the real voice data-base so that the accent amount (pitch) of each mora is determined according to the accent environment, more particularly, according to the boundary of accent phrase such as whether the accent is positioned at a forward or back position, or whether the accent does not exist.

With the thus arranged apparatus for speech synthesis, the basic accent pattern is classified according to the boundary position of the accent in the basic accent pattern table 7*a*. Accordingly, the boundary position of the accent becomes clear and therefore the synthetic voice has a clear boundary position of the accent, that is, the synthetic speech sounds with modulation.

Figures 4, 5:
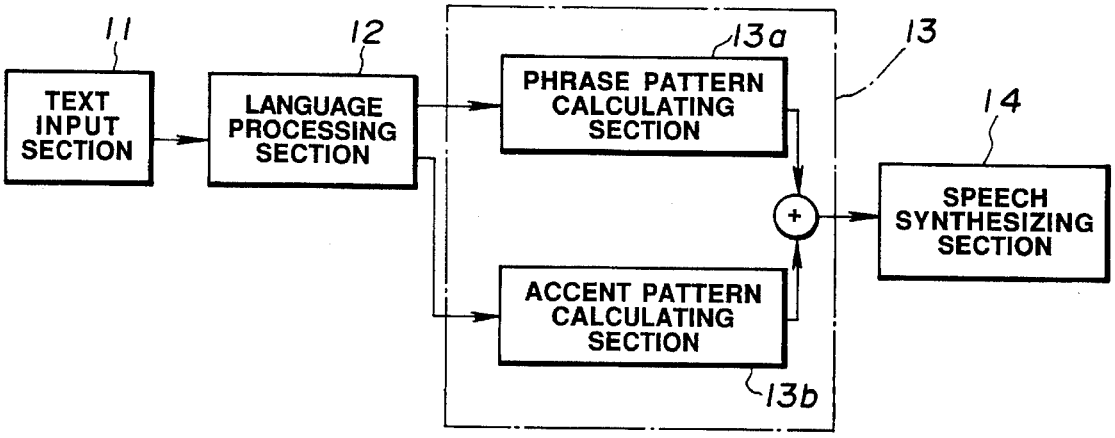
FIG. 5 (PRIOR ART)
FIG. 4 is another accent pattern table which is used in a third embodiment of the speech synthesis apparatus according to the present invention.
FIG. 5 is a block diagram of a conventional speech synthesizing apparatus.
Figure 6:
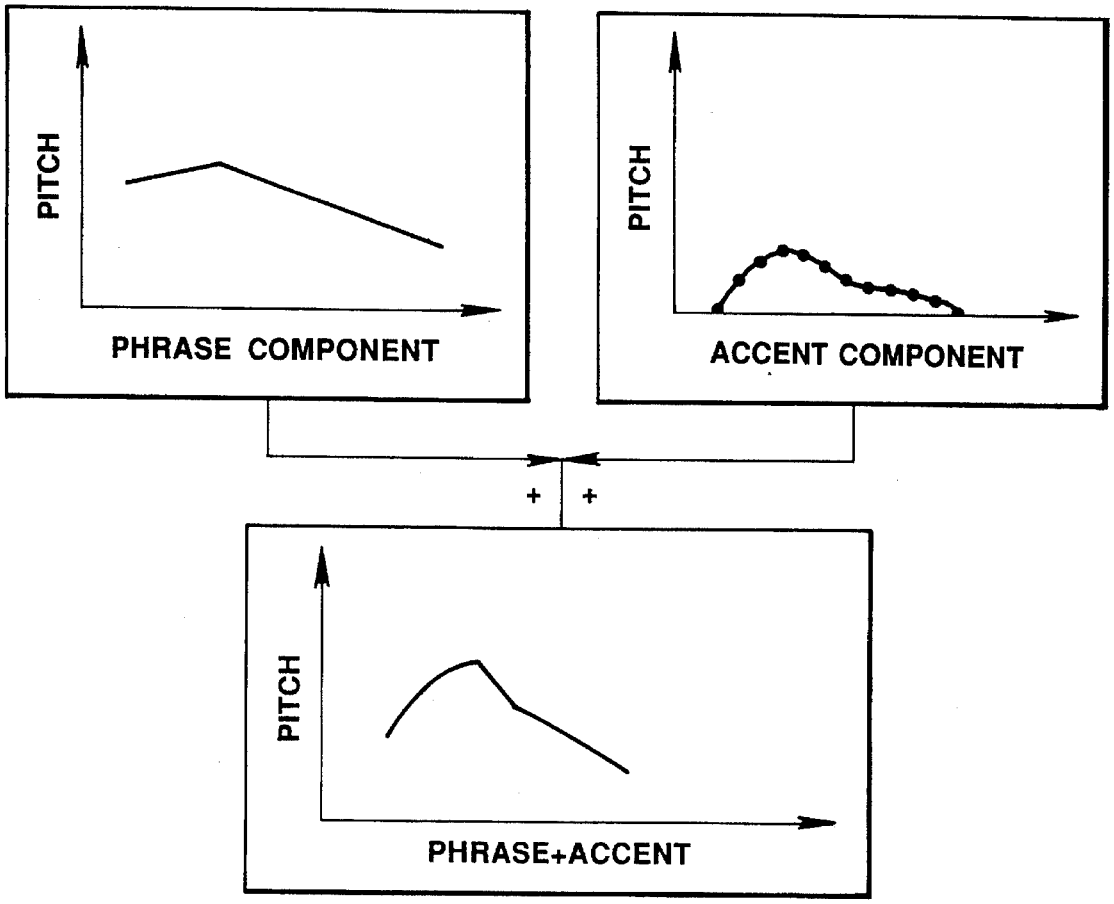
FIG. 6 (PRIOR ART)
FIG. 6 shows graphs for explaining the generation of an accent control pattern by the apparatus of FIG. 5.

Referring to FIG. 4, there is shown another basic accent pattern table 7*b* of a third embodiment of the apparatus S for speech synthesis according to the present invention. The third embodiment of the apparatus S for speech synthesis is similar to the first embodiment except for the basic accent pattern 7*b*.

The basic accent pattern table 7*b* is classified so that the accent amount in each mora is determined according to the property of mora which indicates the difference of the structure of mora. The property of mora is supplied from the language processing section 2 to the basic accent pattern processing section 6 with the number of moras in each boundary and the accent pattern. Accordingly, the proper accent pattern is looked up from the basic accent pattern table 7*b* according to the property of the mora and the accent environment.

With the thus arranged apparatus S for speech synthesis, the basic accent pattern is prepared according to the property of mora. Accordingly, even if the mora has the same accent environment as the other, the proper accent pattern for the mora is selected since the basic accent pattern table 7*b* is classified in accordance with whether the pattern of the mora is vowel mora, vocal consonant+vowel (mora), or voiceless consonant+vowel (mora). Furthermore, the accent pattern is classified according to whether the vowel part has a long sound or not. Accordingly, the synthesized sound further approaches the human voice which has a different accent according to the difference of the mora property.

While the embodiments of the present invention have been shown and described so that the apparatus processes the text written in the Japanese language, it will be appreciated that the principle of the present invention may be applied to other languages.

What is claimed is:

1. An apparatus for synthesizing speech from text, comprising:

a language processing section determining an accent environment of each mora of each phrase of the text, said accent environment including a height of an accent of each mora;

a basic accent pattern table in which a basic accent pattern has been classified according to an accent environment of the mora, the basic accent pattern including pitch data which has been edited from real voice data according to the accent environment;

a basic accent pattern processing section selecting the basic accent pattern of each mora from said basic accent pattern table according to the accent environment and processing the basic accent pattern in a pitch according to the accent environment;

a correcting section receiving the basic access pattern in the pitch in said basic accent pattern processing section and correcting the pitch according to the number of moras in each phrase and the position of the moras in the phrase so as to correct the data in the corrected accent component;

a phrase pattern processing section determining a phrase component according to the number of moras in each phrase of the accent environment; and a speech synthesizing section synthesizing speech according to an accent control pattern of the text which is obtained by adding the basic accent pattern and the basic phrase pattern.

2. An apparatus for synthesizing speech from text as claimed in claim 1, wherein said basic accent pattern table is classified in accordance with an accent environment and a position of an accent boundary.

3. An apparatus for synthesizing speech from text as claimed in claim 2, wherein the position of the accent is determined in accordance with whether the accent boundary is positioned at a forward portion of the mora or at a back portion of the mora.

4. An apparatus for synthesizing speech from text as claimed in claim 2, wherein the type of the mora is determined in accordance with whether the mora is a vowel, vocal consonant and vowel, voiceless consonant and vowel, long vowel, vocal consonant and long vowel, or voiceless consonant and long vowel.

5. An apparatus for synthesizing speech from text as claimed in claim 1, wherein said basic accent pattern table is classified in accordance with the accent environment of each mora and the type of each mora.

6. An apparatus for synthesizing speech from text as claimed in claim 1, wherein the maintenance of the apparatus is carried out by correcting the pitch data in said accent pattern table.

7. An apparatus as claimed in claim 1, further comprising a text input section at which the text is transmitted into signals and sent to said language processing section.

8. An apparatus for synthesizing speech from text as claimed in claim 1, wherein the accent environment includes the height of an accent of each mora and the accent height of forward and back moras of each mora.

9. An accent pattern calculating section in an accent control section of a speech synthesizer, the speech synthesizer having a text input section for inputting text data, the text input section being connected to a language processing section for analyzing the content of the text with morpheme analysis, an accent pattern component obtained from said accent pattern calculating section being combined with a phrase component formed in a phrase pattern calculating section, said accent pattern calculating section comprising:

a basic accent pattern table having a basic accent pattern classified according to an accent environment of the mora which includes a height of an accent of each mora, the basic accent pattern including pitch data which has been edited from a real voice data according to the accent environment;

a basic accent pattern processing section selecting the basic accent pattern of each mora from said basic accent pattern table according to the accent environment and processing the basic accent pattern in a pitch according to the accent environment; and a correcting section receiving the basic accent pattern with the pitch from said basic accent pattern processing section and correcting the pitch according to the number of moras in each phrase and the position of the moras in the phrase, so as to correct the data in a corrected accent component.

10. A method for synthesizing speech from text, comprising the steps of:

a) inputting text data into a text input section;

b) analyzing the contents of the text in a language processing section with morpheme analysis;

c) obtaining an accent pattern component from an accent pattern calculating section;

d) obtaining a phrase component from a phrase pattern calculating section; and e) combining said accent pattern component with said phrase component, wherein said step c) further comprises the steps of classifying a basic accent pattern in a basic accent pattern table according to an accent environment of each mora of the text data, the basic accent pattern including pitch data which has been edited from real voice data according to the accent environment;

selecting the basic accent pattern of each mora from said basic accent pattern table in a basic accent pattern processing section according to the accent environment and processing the basic accent pattern in a pitch according to the accent environment; and receiving the basic accent pattern with the pitch from said basic accent pattern processing section in a correcting section and correcting the pitch according to the number of moras in each phrase and the position of the moras in the phrase so as to correct the data in a corrected accent component.

* * * * *